US008893941B2

(12) United States Patent
Pinto

(10) Patent No.: US 8,893,941 B2
(45) Date of Patent: Nov. 25, 2014

(54) TRIGGER OPERATED BRAKE FOR HANDHELD TAPE DISPENSER

(76) Inventor: Philo Jefferson Pinto, Pleasant Hill, CA (US)

( * ) Notice: Subject to any disclaimer, the term of this patent is extended or adjusted under 35 U.S.C. 154(b) by 228 days.

(21) Appl. No.: 12/913,365

(22) Filed: Oct. 27, 2010

(65) Prior Publication Data

US 2012/0104067 A1 May 3, 2012

(51) Int. Cl.
*B26F 3/02* (2006.01)
*B65H 35/00* (2006.01)

(52) U.S. Cl.
CPC ..... *B65H 35/0033* (2013.01); *B65H 2403/725* (2013.01)
USPC ..... 225/56; 225/82; 225/87

(58) Field of Classification Search
USPC ..... 225/82, 79, 56, 61, 66, 87
See application file for complete search history.

(56) References Cited

U.S. PATENT DOCUMENTS 3,051,223 A * 8/1962 Edward ..... 156/527
3,374,139 A * 3/1968 Fritzinger ..... 156/523
3,969,181 A * 7/1976 Seabold ..... 156/577
4,244,503 A * 1/1981 Kramer ..... 225/46
4,511,427 A * 4/1985 Karliner et al. ..... 156/523
4,718,971 A * 1/1988 Summers ..... 156/540
4,762,586 A * 8/1988 Wilkie ..... 156/527
5,110,401 A * 5/1992 Huang ..... 156/527
5,164,038 A * 11/1992 Sundqvist ..... 156/577
5,236,540 A * 8/1993 Shi ..... 156/523
5,316,613 A * 5/1994 Samuelson et al. ..... 156/540
5,725,726 A * 3/1998 Yu ..... 156/577
5,792,310 A * 8/1998 Thompson et al. ..... 156/523
6,159,328 A * 12/2000 Gaikoski et al. ..... 156/269
6,540,002 B1 * 4/2003 Edwards et al. ..... 156/577
6,612,474 B2 * 9/2003 Shah ..... 225/51
6,913,178 B2 * 7/2005 Huang ..... 225/35
7,195,048 B2 * 3/2007 Wojtkun et al. ..... 156/527
7,357,285 B2 * 4/2008 Namekawa et al. ..... 225/6
7,506,835 B2 * 3/2009 Huang ..... 242/588
2003/0116598 A1 * 6/2003 Huang ..... 225/56
2006/0201984 A1 * 9/2006 Namekawa et al. ..... 225/6
2007/0246153 A1 * 10/2007 Schurman ..... 156/185
2010/0084450 A1 * 4/2010 Vulpitta ..... 225/47

* cited by examiner

*Primary Examiner* — Omar Flores Sanchez
(74) *Attorney, Agent, or Firm* — Paul B. Heynssens Attorney at Law, PLC

(57) ABSTRACT

A mechanism to halt the dispensing of pressure sensitive adhesive tape from a handheld dispenser with a finger operated trigger (10) which forces lever (13) to engage brake plate (15) with cogs to mesh with the cogs on the cogged spool holder (16) to positively stop the dispensing of tape.

5 Claims, 7 Drawing Sheets

TRIGGER OPERATED BRAKE FOR HANDHELD TAPE DISPENSER

CROSS-REFERENCE TO RELATED APPLICATIONS

Figure 1:
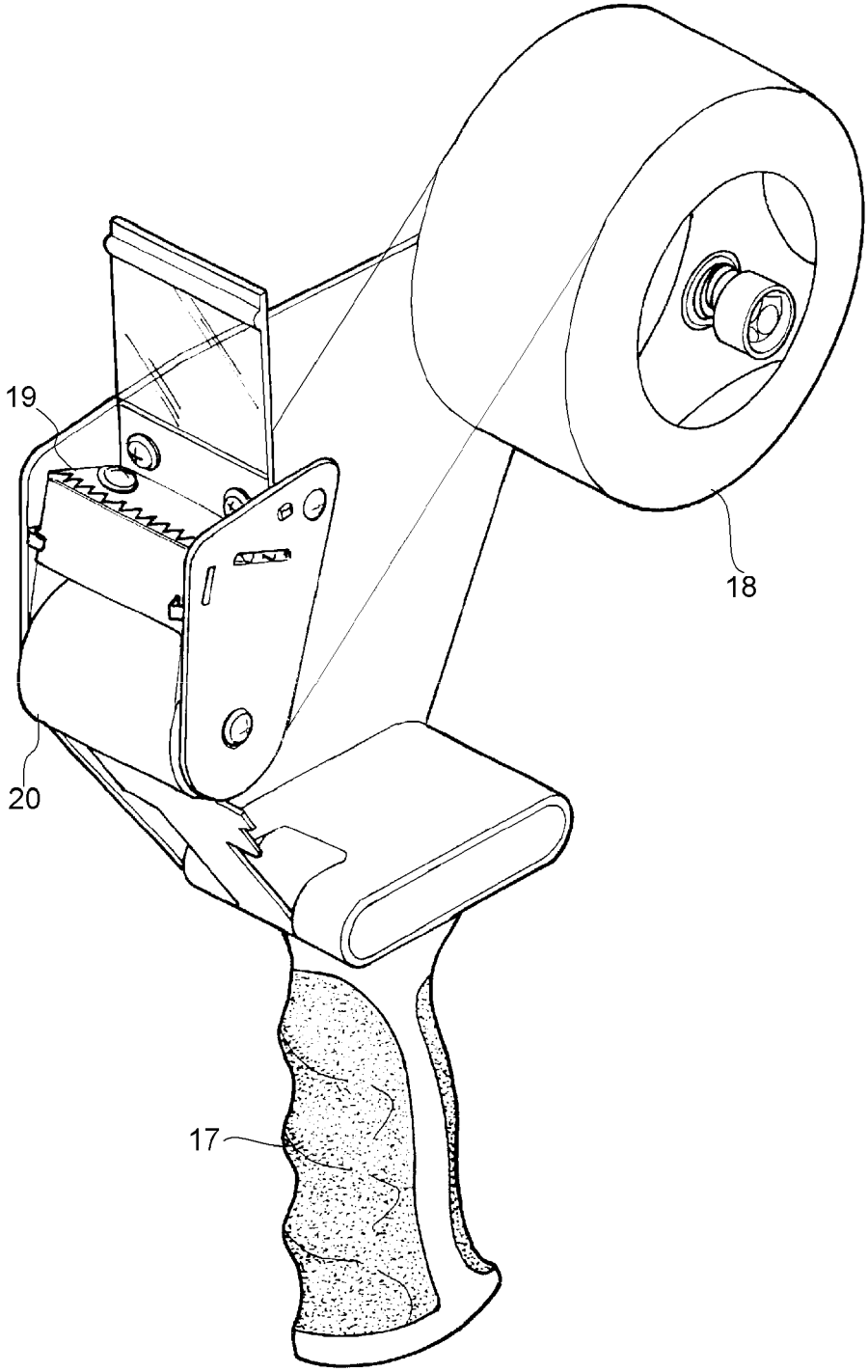

This application claims the benefit of the following patents:

| | | |
|---|---|---|
| 3,374139 | Fritzinger | 1964 |
| 7,506,835B2 | Huang | 2009 |
| 6,612,474B2 | Shah | 2003 |
| 4,762,586 | Wilkie | Aug. 09, 1988 |
| 5,110,401 A | Huang | May 1992 |
| 5,725,726 | Yu | 1998 |
| 5,564,645 | Lissoni | 1996 |
| CA 2685565 (A1) | Steele | 2008 |

FEDERALLY SPONSORED RESEARCH

Not applicable

SEQUENCE LISTING PROGRAM

Not applicable

BACKGROUND OF THE INVENTION

1. Field of Invention

This invention relates to a manual hand held dispenser for pressure sensitive adhesive tape used to apply tape to packaging products and a means for cutting the tape once applied.

2. Prior Art

A common type of packaging is corrugated boxes. These packages are sealed prior to storage or shipment and much of the sealing is done with pressure sensitive adhesive tape. Previously, while there are various types of hand held versions of dispensers for pressure sensitive tape, current designs employ a spatula and or a retractable cutter that protrudes via pressure being exerted on the spatula. This requires the user to apply a perfect balance of pressure to the spatula and toward the cutter and position the dispenser at the perfect angle. The desired result is a clean cut in the tape at the desired length applied to the package.

All too often, if the balance of pressure and the angle is not correct, the result is the tape cut being longer than the desired length or a cut that is frayed by the jagged cutting blade. Moreover, the various manufactures of pressure sensitive tape have different strengths of adhesive, different tape materials, and different thicknesses resulting in variability that changes the user's technique to yield a perfect cut.

U.S. Pat. No. 4,762,586 to Wilkie (1988) has a manually operated trigger that operates the cutter, but does not lock the roll of tape. If the cutter isn't applied just right, the tape will continue to dispense, resulting in excess tape with a less than perfect cut.

Prior art also includes various adjuncts such as U.S. Pat. No. 7,506,835B2 to Huong (2009) and U.S. Pat. No. 5,110,401A Huang (1992) and U.S. Pat. No. 5,564,645 to Lissoni (1996) that apply friction to the tape reel to maintain a uniform tension. This approach is helpful to keep the tape taut while applying the tape around the right angles of the container, but doesn't positively stop the tape for cutting. There is a delicate balance of how much tension to put the spool holding the roll of tape. With too little tension, the tape roll continues spinning after the cut because of the sudden loss of tension. When the tape roll spins, the tape unravels and becomes entangled. When this occurs, the user must locate the end of the tape on the roll and rethread it through the dispenser. Conversely, with too much tension on the tape reel, it requires excessive effort to dispense the tape. To complicate matters worse, the amount of effort to dispense the tape changes as the diameter of the roll changes. That is, the roll gets smaller as the tape is consumed.

The tape break in U.S. Pat. No. 6,612,474B2 to Shah (2003) is suitable for a narrow tape dispenser common in an office environment. It relies on the strength of the user's two fingers to stop the dispensing of the tape. Furthermore, since it requires the user's hand to reach around the roll of tape, it is not practical for rolls with larger diameter or width such as the two inch wide tape used to close packages.

U.S. Pat. No. 3,374,139 to Fritzinger (1964) named Tape Dispenser with Hand Brake, applies variable pressure to increase tension or stop the dispensing of the tape. This mechanical design is very complex and relatively expensive to manufacture. This is evident by the lack of widespread commercialization. Moreover, it requires the user to exert increasing pressure as the desire for more tension increases. Lastly, the means used to increase tension and stop the tape when it comes in direct contact with the adhesive side of the tape thereby adversely affecting the strength of the adhesive and increasing the propensity to jamb or become tangled.

OBJECTS AND ADVANTAGES

Accordingly, several objects and advantages of the invention are the ability of the user to decisively choose the exact point to terminate and then cut the tape. This is achieved with a single finger operated trigger that is accessible with the same hand that is holding the tape dispenser. Because of the slow speed the tape unwinds and the brake is sudden not gradual. With the dispensing of the tape halted, the user can then perform the cut at the desired point thus eliminated "run on" tape.

With the reel and supply roll positively stopped, the tape supply can not keep spinning and tangle thus eliminating wasted tape. Additionally, there are fewer instances of tape becoming tangled eliminating the need to rethread the tape in the dispenser thus decreasing work stoppages and increasing productivity.

The advantage of a sudden stop is the same low strength effort is required to stop the tape from dispensing irrespective of tape thickness, materials, or quantity of the remaining tape on the roll. That is, the effort doesn't change as the size of the tape supply roll changes when it gets smaller as the tape is consumed. Moreover, the different types of tapes vary as to thickness and strength of material. The variability in materials will not change the effort required to depress the trigger and positively stop the tape from dispensing.

Positively stopping the dispensing of tape will also compensate for a dull cutting blade. That is, the dispenser will perform consistently when the cutting blade degrades.

The design of the tape break mechanism has fewer moving parts than its and is simpler to manufacture than previous devices that tension or stop the tape from dispensing. Moreover, the design uses the same simple procedure to load the tape as contemporary tape dispensers. The trigger and braking mechanism is contained within the contemporary design rendering it less vulnerable to destruction if dropped.

Further objects and advantages will become apparent from a consideration of the ensuring description.

SUMMARY

In accordance with the invention, this device overcomes many shortcomings of prior versions of hand held pressure sensitive tape dispensers inasmuch as it has a user operated trigger that stops the tape reel from turning and allows a precise cut of the tape with less skill and effort. Furthermore, it substantially reduces the instances of the tape becoming entangled in the dispenser and reduces the need to rethread the tape.

DRAWINGS

Figures

FIG. 1. is an illustration of prior art.

Figure 2:
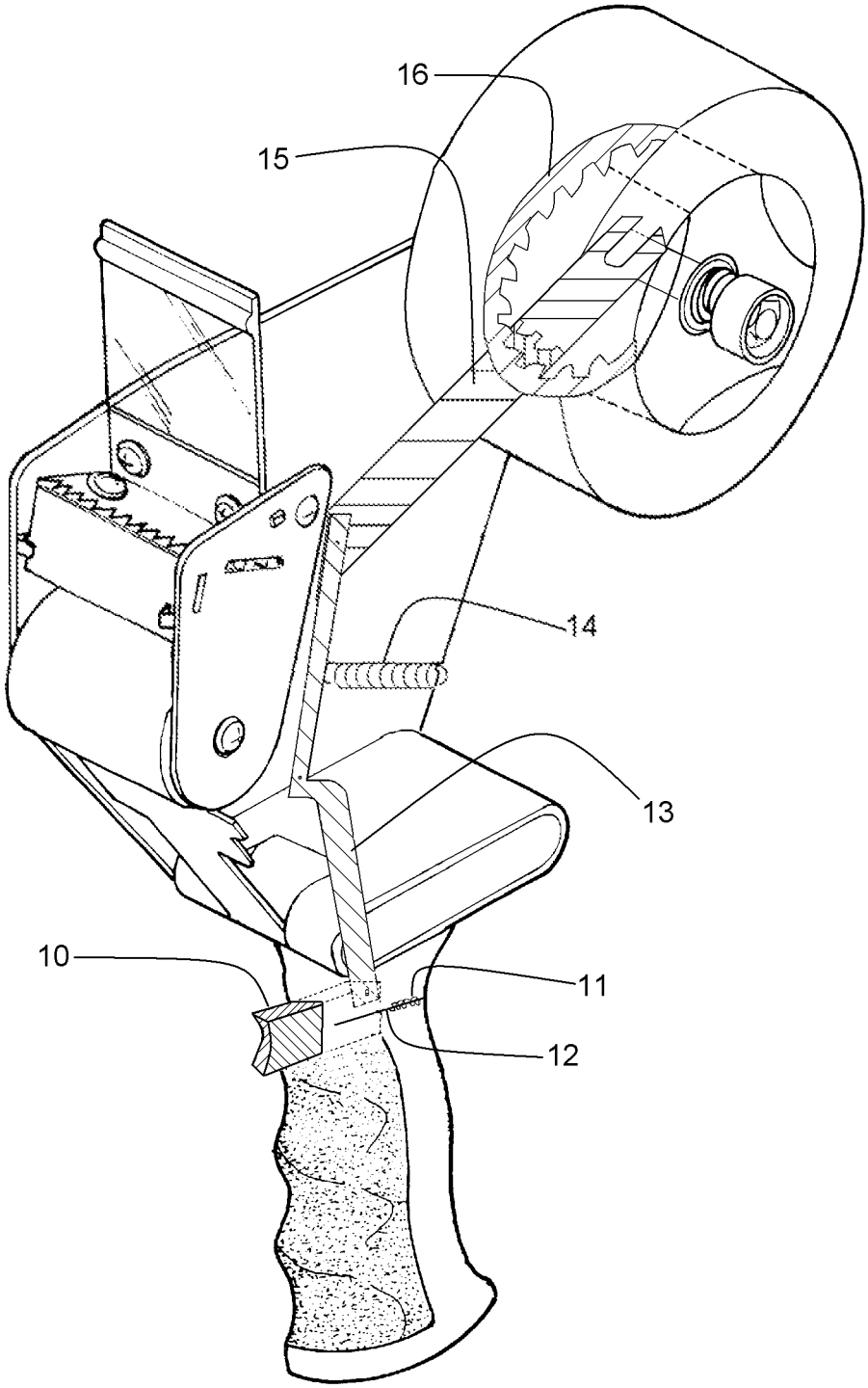

FIG. 2. is a perspective of the left side of the entire device including new art.

Figure 3A:
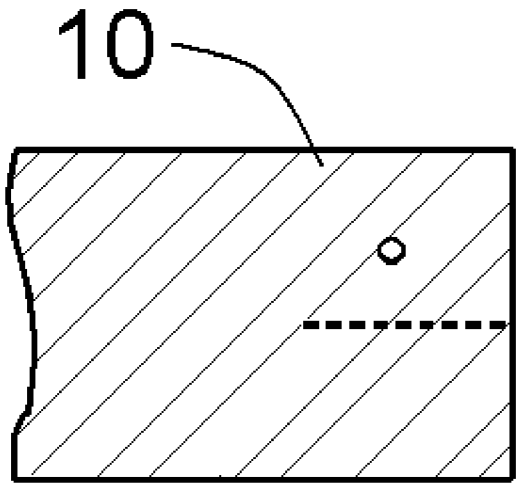

FIG. 3A. is a left side view of the trigger

Figure 3B:
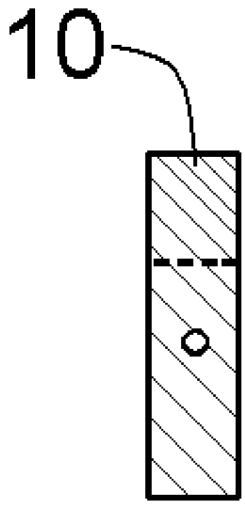

FIG. 3B. is the rear side of the trigger.

Figure 4A:
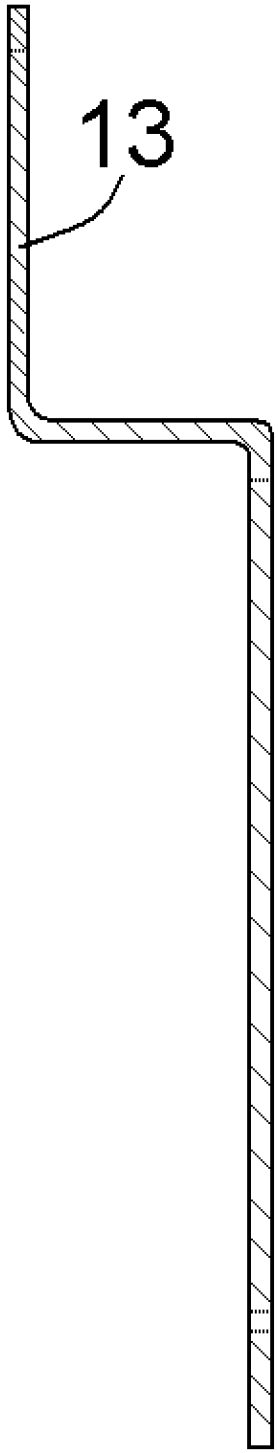

FIG. 4A. is the rear view of the lever.

Figure 4B:
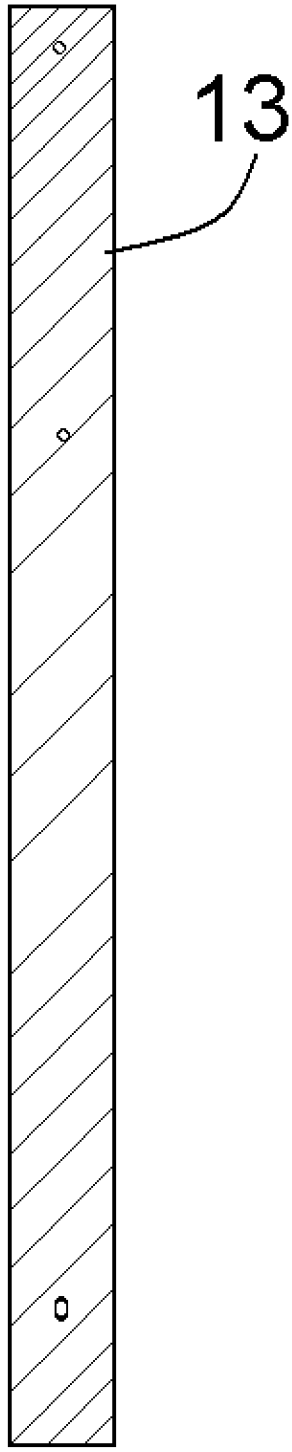

FIG. 4B. is the side view of the Lever.

Figure 5A:
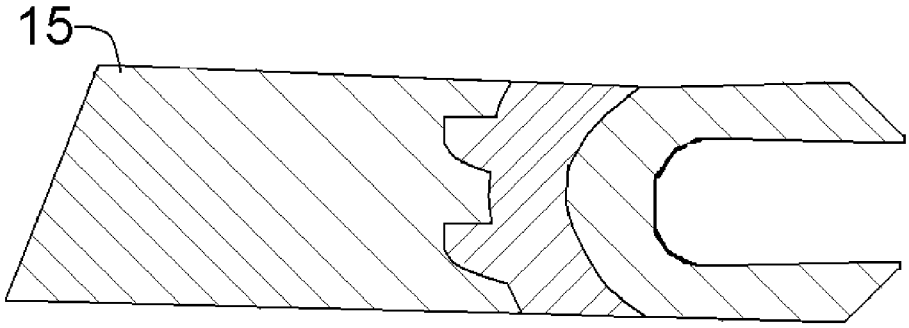

FIG. 5A. is the left view of the brake plate.

Figure 5B:
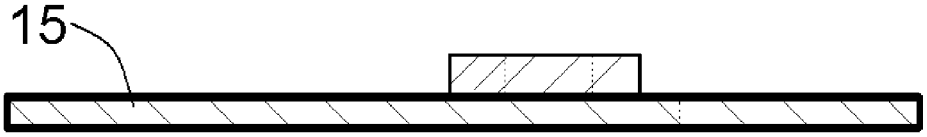

FIG. 5B. is the top view of the brake plate.

Figure 6A:
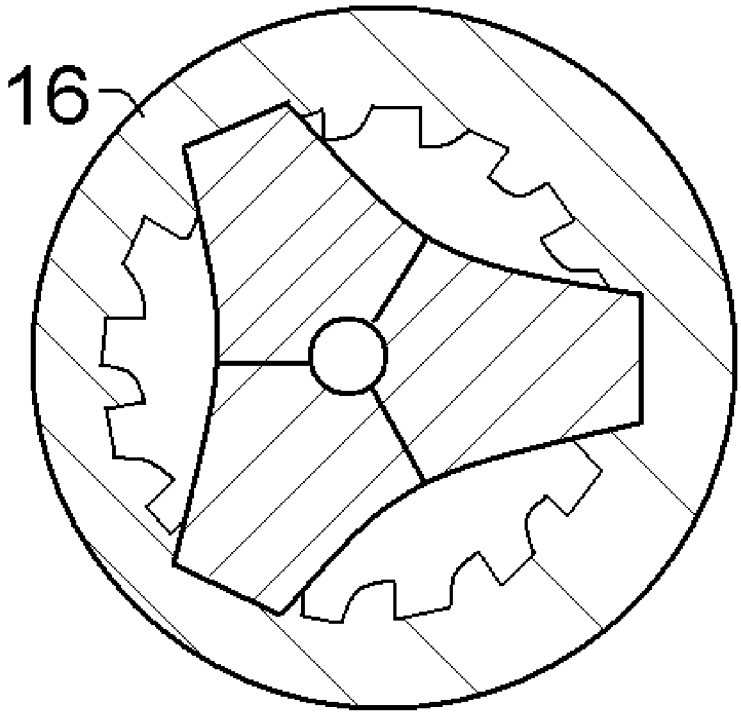

FIG. 6A. is the side view of the cogged spool holder

Figure 6B:
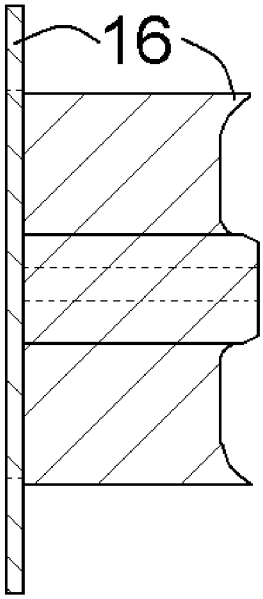

FIG. 6B. is the rear view of the cogged spool holder

Figure 7:
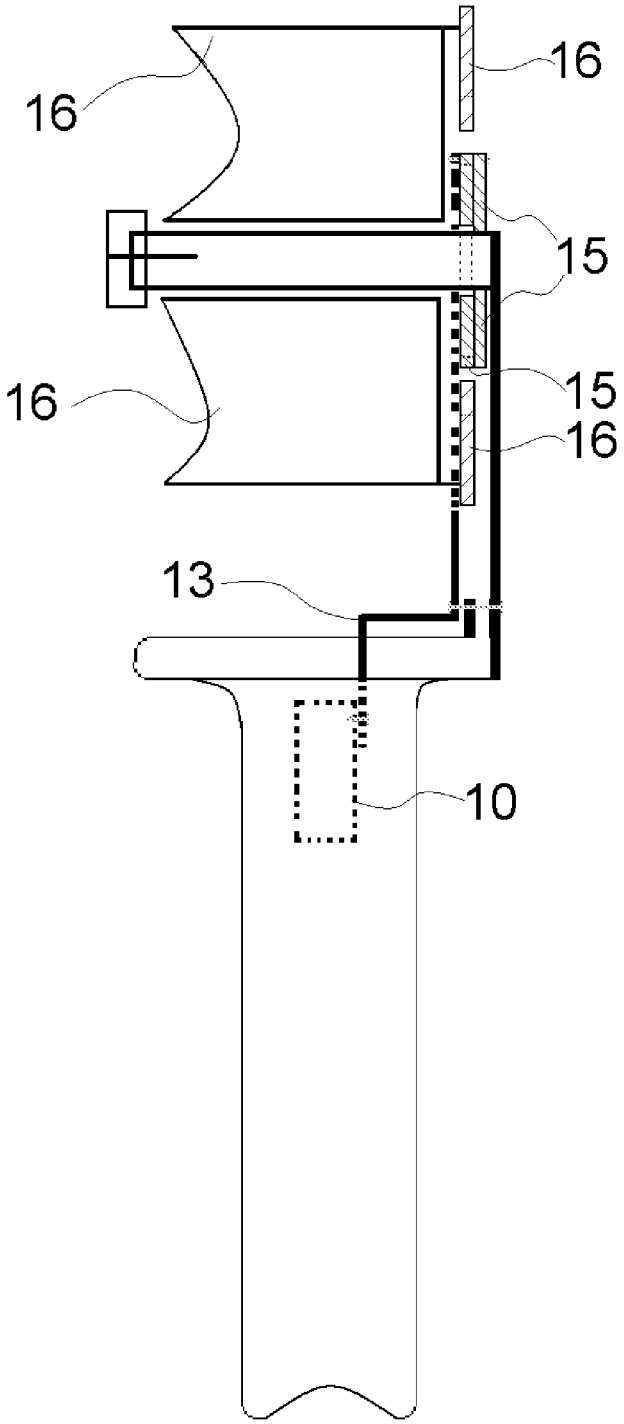

FIG. 7. Is the rear cutaway view of the entire device.

| DRAWINGS - REFERENCE NUMERALS | |
|---|---|
| 10 trigger | 11 trigger guide rod |
| 12 trigger return spring | 13 lever |
| 14 lever return spring | 15 brake plate |
| 16 cogged spool holder | 17 handle |
| 18 tape supply reel | 19 cutting blade |
| 20 idler pulley | |

DETAILED DESCRIPTION

Preferred Embodiment—FIG. 2

The preferred embodiment of the trigger operated brake is illustrated in FIG. 2. (left side view). As the tape is being dispensed, the cogged spool holder 16 rotates counterclockwise. When the desired amount of tape has been dispensed, the user depresses the trigger 10 (FIGS. 3A and 3B).

The trigger 10 has a trigger guide rod 11 (FIG. 2) and a trigger return spring 12 (FIG. 2) to ensure smooth and consistent movement. The trigger 10 pushes the lever 13 (FIGS. 4A and 4B) and the lever pulls the brake plate 15 (FIGS. 5A and 5B). The raised portion of the brake plate 15 bearing curved teeth, slides into the curved teeth on the rotating spool holder 16. The curved shape of the teeth on the brake plate 15 and the spool holder 16 allow the cogs to mesh together quickly and immediately stop the spool holder 16 from turning; thus stopping the dispensing of the tape. The user then exerts force to stretch the tape over the blade to perform the cut.

After the cut is complete, the user releases the trigger 10. The trigger return spring 12 restores the trigger to its normal position. The lever return spring 14 returns the lever 13 to it's ready to use position and retracts the brake plate 15 teeth from the teeth of the spool holder 16.

The user may also stop the dispensing of tape to increase tension and release the trigger without cutting the tape.

CONCLUSION, RAMIFICATIONS, AND SCOPE

Accordingly the reader will see according to the invention, I have provided a substantially easier to use and a more reliable means to dispense and cut pressure sensitive tape from a hand held dispenser. Furthermore the trigger operated brake for a handheld tape dispenser has additional advantages which are:

- it decisively permits the cut off of the tape when the user chooses via a trigger;
- it substantially reduces the need to untangle and rethread the tape;
- it uses a small quantity of strength to operate the trigger from a single finger from the same hand to operate;
- it works consistently with different thicknesses of tape;
- it is substantially simpler, has fewer moving parts, and is less expensive to manufacture than previous tape brakes;
- it can also be used to stop the tape to add additional tension when going around the corners of a box.

While the above description contains many specificities, these should not be construed as limitations on the scope of the invention, but as exemplifications of the presently preferred embodiments thereof. Many other ramifications and variations are possible within the teachings of the invention. For example, range of motion of the trigger, length of the lever, the size and shape of the brake plate and the size and shape of the cogged spool holder.

Thus the scope of the invention should be determined by the appended claims and their legal equivalents, and not by the examples given.

SEQUENCE LISTING

Not applicable

The invention claimed is:

1. A handheld dispenser of pressure sensitive adhesive tape comprising:

a handle, and a rotating spool holder including a brake plate and holding a roll of pressure sensitive adhesive tape on the tape spool holder a cutting blade;

an idler pulley; and a finger activated trigger stopping the motion of the tape supply reel holder by engaging the brake plate through actuating a lever coupling the brake plate and the trigger, thus stopping the dispensing of tape when the trigger is pressed by a finger.

2. A device according to claim 1, wherein the device includes a spring biased trigger which is coupled to the lever.

3. The device according to claim 1, wherein the lever is coupled to the brake plate, the brake plate being toothed.

4. The device according to claim 1, wherein the brake plate interlocks with teeth disposed in the spool holder to prevent it from turning.

5. The device according to claim 4, wherein the toothed brake plate engages a plurality of teeth disposed about an interior circumference of the rotating spool holder.

* * * * *